US008418710B2

(12) United States Patent
Zhou

(10) Patent No.: US 8,418,710 B2
(45) Date of Patent: Apr. 16, 2013

(54) TENT TOP ASSEMBLY

(75) Inventor: Nanqing Zhou, Xiamen (CN)

(73) Assignee: Q-Yield Outdoor Gear Ltd., Xiamen, Fujian (CN)

( * ) Notice: Subject to any disclaimer, the term of this patent is extended or adjusted under 35 U.S.C. 154(b) by 0 days.

(21) Appl. No.: 13/289,011

(22) Filed: Nov. 4, 2011

(65) Prior Publication Data

US 2012/0195682 A1 Aug. 2, 2012

(30) Foreign Application Priority Data

Jan. 28, 2011 (CN) ..... 2011 2 0030538 U

(51) Int. Cl.
*E04H 15/36* (2006.01)
*E04H 15/28* (2006.01)

(52) U.S. Cl.
USPC ..... 135/135; 135/98; 135/147; 135/28; 403/171; 403/217

(58) Field of Classification Search ..... 135/90, 135/135, 147, 159, 21, 28, 120.3, 120.4; 52/86, 81.2, 81.3, 645, 646; 403/170–173, 403/217–219
See application file for complete search history.

(56) References Cited

U.S. PATENT DOCUMENTS

| | | | | |
|---|---|---|---|---|
| 2,864,389 | A * | 12/1958 | Smith et al. | 135/98 |
| 4,368,749 | A * | 1/1983 | Lindler et al. | 135/15.1 |
| 5,193,566 | A * | 3/1993 | Chen | 135/28 |
| 5,444,946 | A * | 8/1995 | Zeigler | 52/86 |
| 6,581,617 | B2 * | 6/2003 | Ham et al. | 135/135 |
| 6,802,329 | B2 * | 10/2004 | Chen | 135/135 |
| 6,854,476 | B1 * | 2/2005 | Chai | 135/135 |
| 7,481,235 | B2 * | 1/2009 | Prusmack | 135/135 |
| 7,866,331 | B2 * | 1/2011 | Glatz | 135/21 |
| 7,891,367 | B2 * | 2/2011 | Ma | 135/19.5 |
| 8,082,938 | B2 * | 12/2011 | Prusmack | 135/135 |
| 2005/0224107 | A1 * | 10/2005 | Yang | 135/135 |
| 2006/0162756 | A1 * | 7/2006 | Gao | 135/98 |

* cited by examiner

*Primary Examiner* — Winnie Yip

(57) ABSTRACT

A tent top assembly is mounted on top of a tent for connecting with a plurality of tent poles. The tent top assembly includes an upper module and a lower module. The upper module includes an upper seat, an upper press member and an upper lid which are separately formed and connected with each other. The lower module includes a lower seat, a lower press member and a lower lid which are separately formed and connected with each other. The upper seat and the lower seat each have a plurality of engaging grooves which are spaced and arranged in a radial form for connection of connecting heads of the tent poles. There is no need for rivets or other fasteners when assembling the present invention, saving the cost and the time of assembly. The tent top assembly can be assembled and disassembled quickly and easily.

7 Claims, 10 Drawing Sheets

TENT TOP ASSEMBLY

BACKGROUND OF THE INVENTION

1. Field of the Invention

The present invention relates to a tent top assembly, and more particularly to a top assembly which is mounted on top of a tent for connecting with tent poles.

2. Description of the Prior Art

A conventional tent comprises a tent canopy and a tent frame to support the tent canopy. The tent frame comprises a top assembly and a plurality of tent poles which are pivotally connected to the top assembly. The top assembly comprises an upper module and a lower module. The upper end of each tent pole is pivoted to the upper module. The lower end of each tent pole is provided with an auxiliary pole. The upper end of the auxiliary pole is pivoted to the lower module. The upper module and lower modules are integrally formed. The upper ends of the tent poles and the auxiliary poles are pivotally connected to the upper and lower modules with rivets. The installing process of the conventional top assembly is complicated, and it needs other mating equipment. The manufacturing cost is high, and it is not easy to dissemble the rivets. The conventional top assembly cannot be applied to different tents. Accordingly, the inventor of the present invention has devoted himself based on his many years of practical experiences to solve these problems.

SUMMARY OF THE INVENTION

The primary object of the present invention is to provide a tent top assembly which can be assembled and disassembled quickly and easily for different tents as desired and is cost-effective.

In order to achieve the aforesaid object, the tent top assembly is mounted on top of a tent for connecting with a plurality of tent poles. The tent top assembly comprises an upper module and a lower module. The upper module comprises an upper seat, an upper press member and an upper lid which are separately formed and connected with each other. The lower module comprises a lower seat, a lower press member and a lower lid which are separately formed and connected with each other. The upper seat and the lower seat each have a plurality of engaging grooves which are spaced and arranged in a radial form for connection of connecting heads of the tent poles.

Preferably, the upper seat further has an annular recess formed on an inner wall thereof. The upper seat further has a bearing base protruding from a central portion thereof. The bearing base has protrusions formed on an outer wall thereof. The upper seat further has a plurality of engaging flanges around an outer wall thereof and a plurality of engaging holes.

Preferably, the upper press member corresponds in shape to the inner wall of the upper seat and is coupled to the upper seat. The upper press member has a plurality of slots corresponding to the engaging grooves of the upper seat and stop blocks disposed above the slots. The upper press member has a central mating hole corresponding to the bearing base and engaging blocks which are disposed on an outer wall of the upper press member and correspond to the engaging holes of the upper seat.

Preferably, the upper lid is fitted on the upper seat. The upper lid has an annular rim and a plurality of protruding blocks formed on an inner wall of the annular rim and corresponding to the engaging flanges of the upper seat.

Preferably, the lower seat further has an annular recess formed on an inner wall thereof. The lower seat further has a hollow axle portion protruding from a central portion thereof. The axle portion has an annular trough formed on an outer wall of a bottom end thereof. The lower seat further has a plurality of engaging flanges around an outer wall thereof and a plurality of engaging holes.

Preferably, the lower press member corresponds in shape to the inner wall of the lower seat and is coupled to the lower seat. The lower press member has a plurality of slots corresponding to the engaging grooves of the lower seat and stop blocks disposed above the slots. The lower press member has a central installing trough corresponding to the axle portion. The installing trough is used to accommodate a quick-release assembly. The installing trough has protrusions formed on a bottom edge thereof. The lower press member has an outer wall formed with engaging blocks corresponding to the engaging holes.

Preferably, the quick-release assembly comprises a pulley unit and a pull rope. The pulley unit is disposed in the installing trough of the lower seat. The pull rope winds round the pulley unit, passes the apertures of the axle portion of the lower seat and the through holes of the bearing base of the upper seat, and extends out of the holes of the upper lid.

Preferably, the lower lid is fitted on the lower seat. The lower lid has an annular rim and a plurality of protruding blocks formed on an inner wall of the annular rim and corresponding to the engaging flanges of the lower seat.

The present invention has the following advantages.

1. The tent top assembly of the present invention is connected in an engaging way. There is no need for rivets or other fasteners when assembling the present invention, saving the cost and the time of assembly.

2. The tent top assembly of the present invention can be assembled and disassembled quickly and easily for different tents as desired, which can be applied to a tent with four, five, six, eight or ten tent poles.

DETAILED DESCRIPTION OF THE PREFERRED EMBODIMENTS

Figure 1:
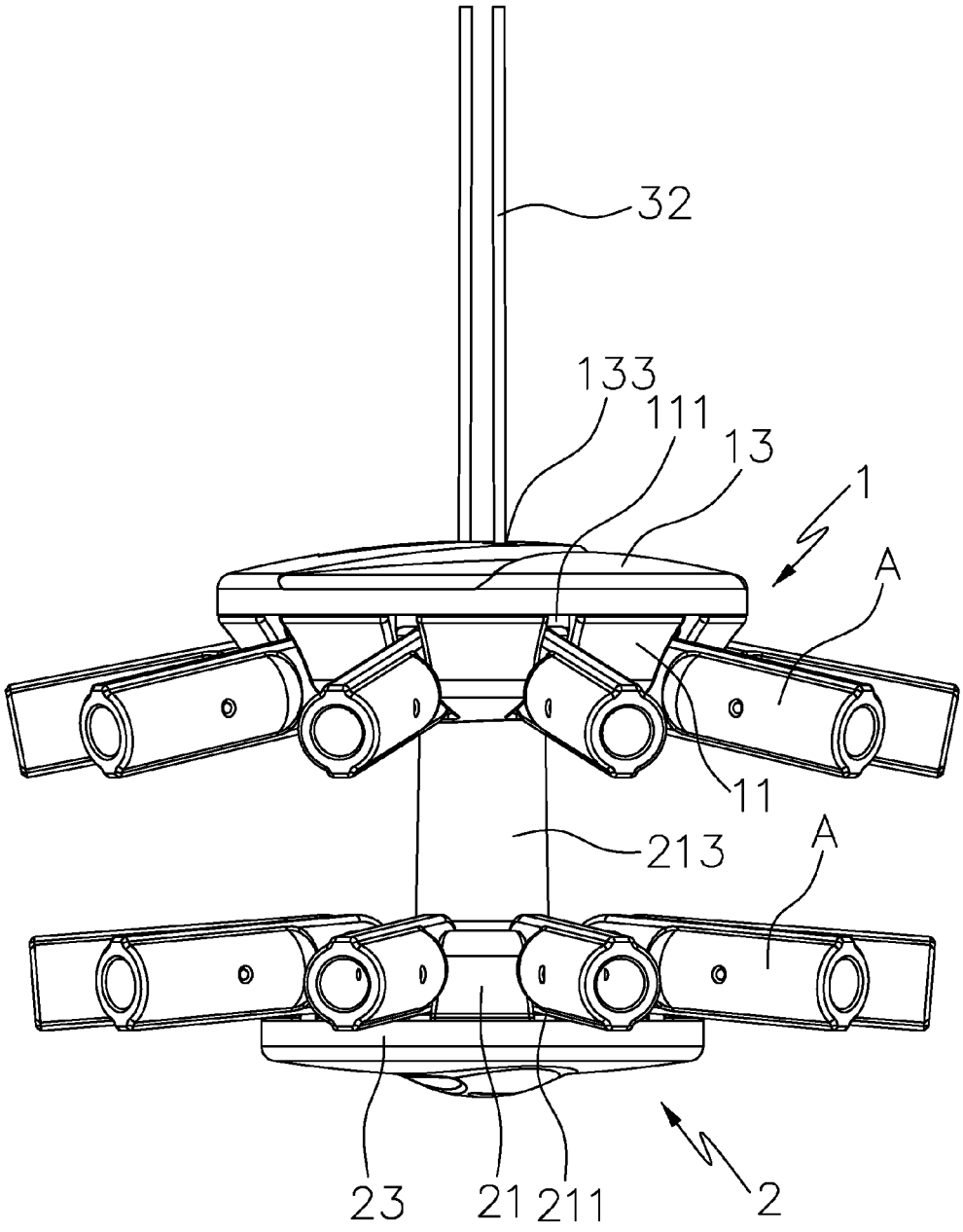
FIG. 1 is a perspective view according to a preferred embodiment of the present invention.
Figure 2:
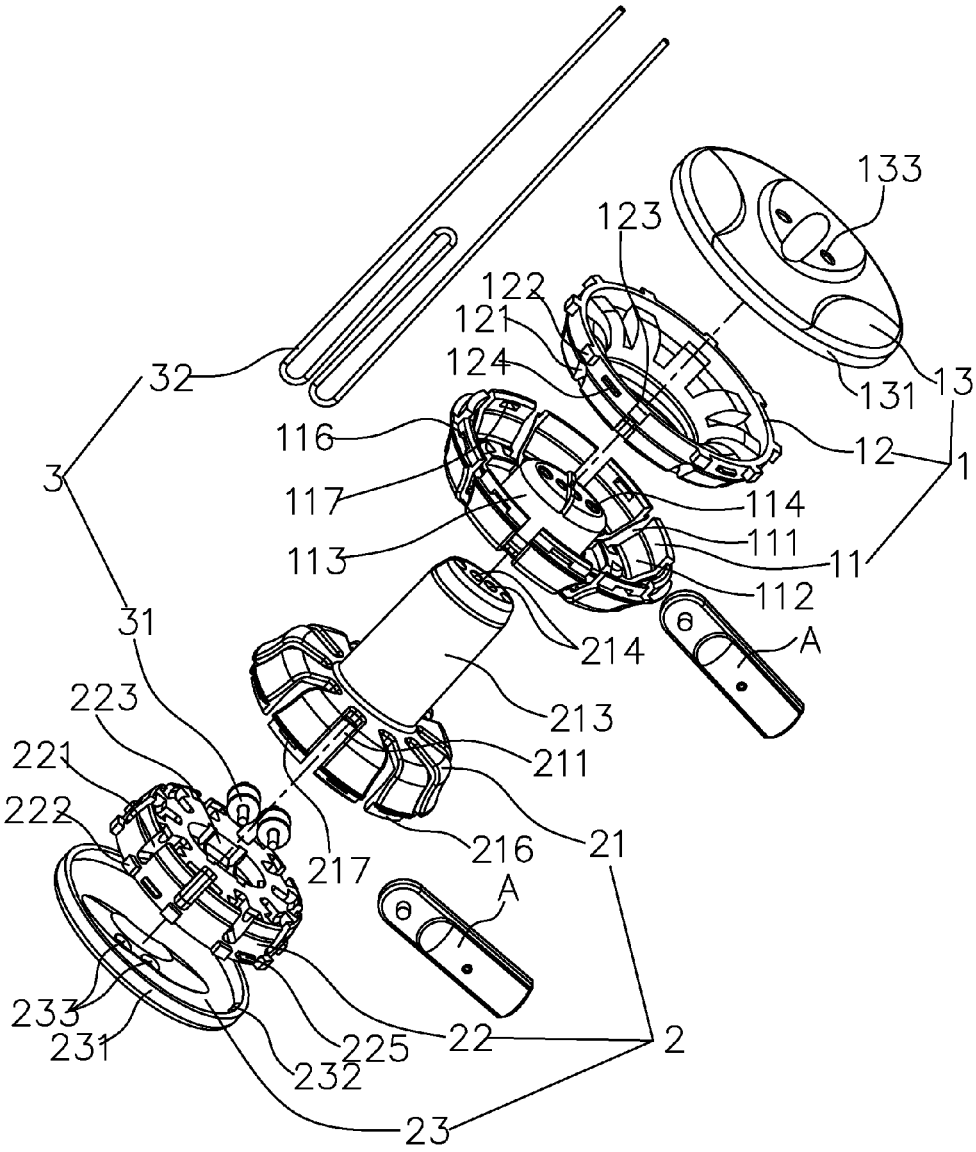
FIG. 2 is an exploded view according to the preferred embodiment of the present invention.
Figure 3:
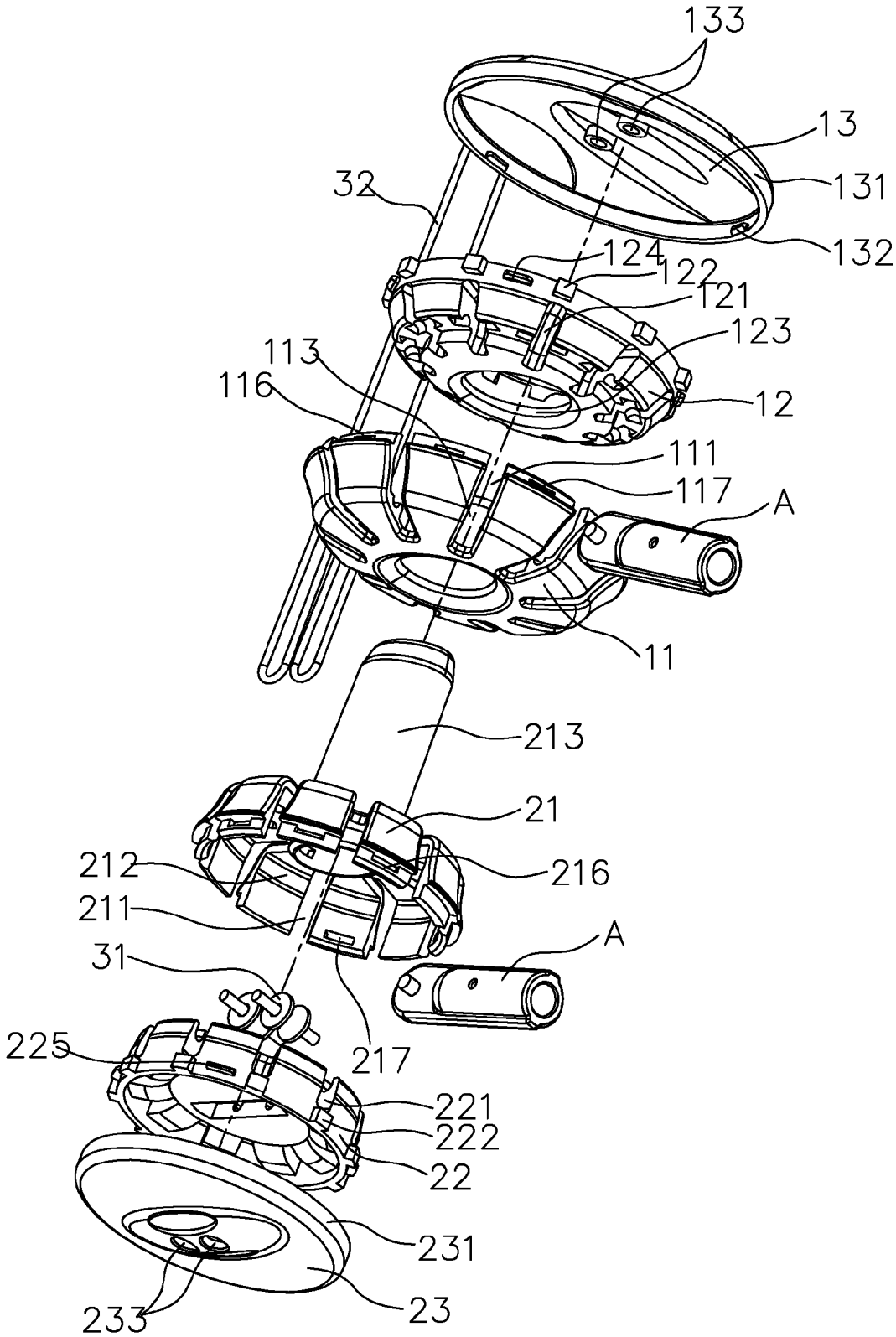
FIG. 3 is another exploded view according to the preferred embodiment of the present invention.
Figure 4:
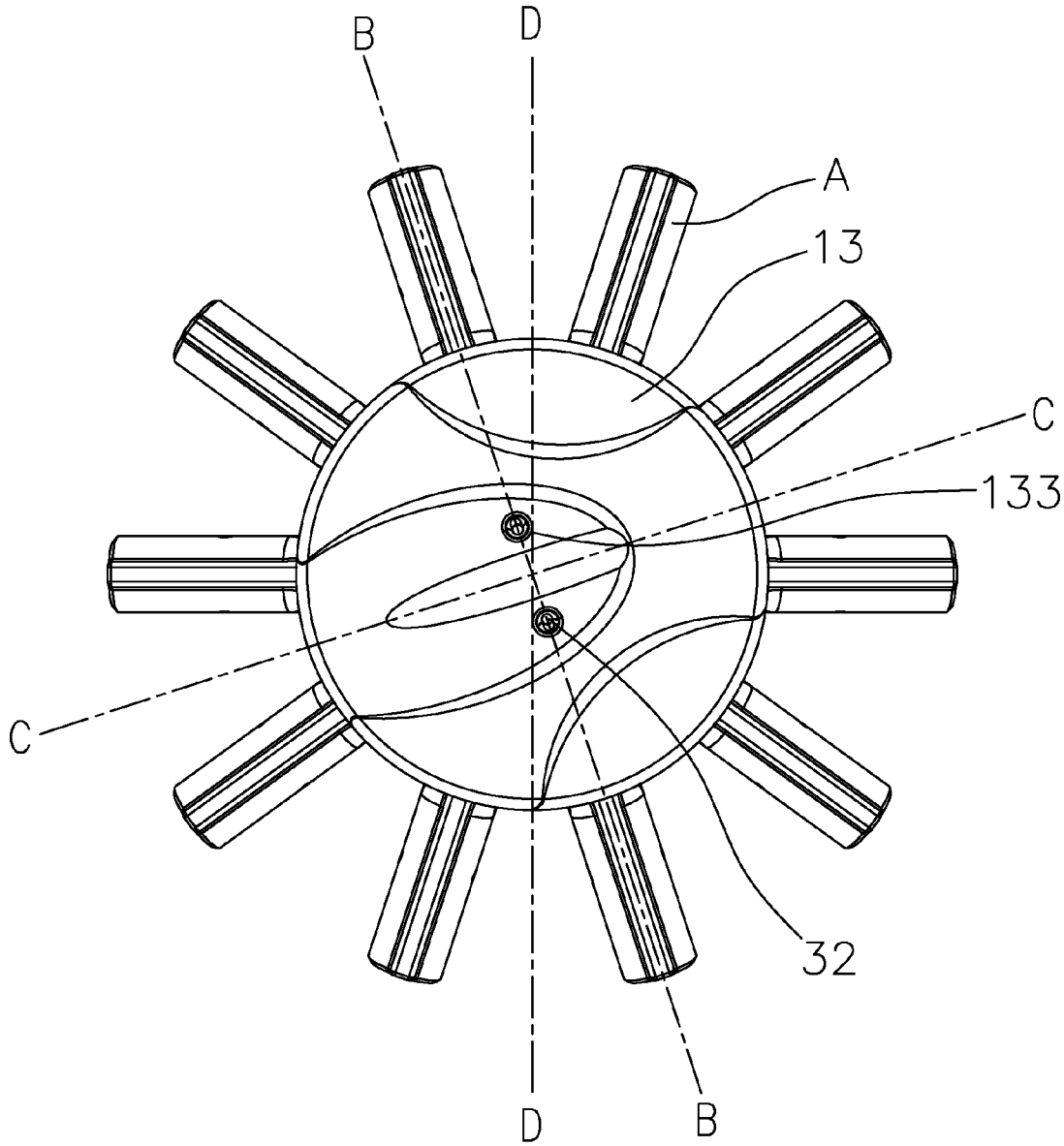
FIG. 4 is a schematic view showing the assembly of the preferred embodiment of the present invention.

Embodiments of the present invention will now be described, by way of example only, with reference to the accompanying drawings.

The top assembly of the present invention is mounted on top of a tent for connecting with a plurality of tent poles to constitute a tent frame. As shown in FIG. 1 through FIG. 7, the top assembly comprises an upper module 1 and a lower module 2. The upper module 1 comprises an upper seat 11, an upper press member 12 and an upper lid 13 which are separately formed and then connected with each other. The upper seat 11 has a plurality of engaging grooves 111 which are spaced and arranged in a radial form for connection of connecting heads A of the tent poles. The upper seat 11 further has an annular recess 112 formed on an inner wall thereof to accommodate the pivots of the connecting heads A of the tent poles. The upper seat 11 further has a bearing base 113 protruding from a central portion thereof. The bearing base 113 has a plurality of through holes 114 and protrusions 115 formed on an outer wall thereof. The upper seat 11 further has a plurality of engaging flanges 116 around an outer wall thereof and a plurality of engaging holes 117.

The upper press member 12 corresponds in shape to the inner wall of the upper seat 11 and is coupled to the upper seat 11. The upper press member 12 has a plurality of slots 121 corresponding to the engaging grooves 111 and stop blocks 122 disposed above the slots 121. The slots 121 are aligned with the engaging grooves 111 of the upper seat 11 and cooperated with the stop blocks 122, such that the connecting heads A of the tent poles can be secured in the engaging grooves 111 of the upper seat 11 of the upper module 1 and the connecting heads A of the tent poles can be turned in a predetermined range to unfold or fold the tent poles. The upper press member 12 has a central mating hole 123 corresponding to the bearing base 113 and engaging blocks 124 which are disposed on an outer wall of the upper press member 12 and correspond to the engaging holes 117. When the upper press member 12 is pressed and connected in the upper seat 11, the engaging blocks 124 are engaged with engaging holes 117 of the upper seat 11. The upper press member 12 is firmly coupled to the upper seat 11 by means of the mating hole 123 and the protrusions 115 formed on the outer wall of the bearing base 113, referring to FIG. 6, FIG. 6A, FIG. 7 and FIG. 7A.

Figure 5:
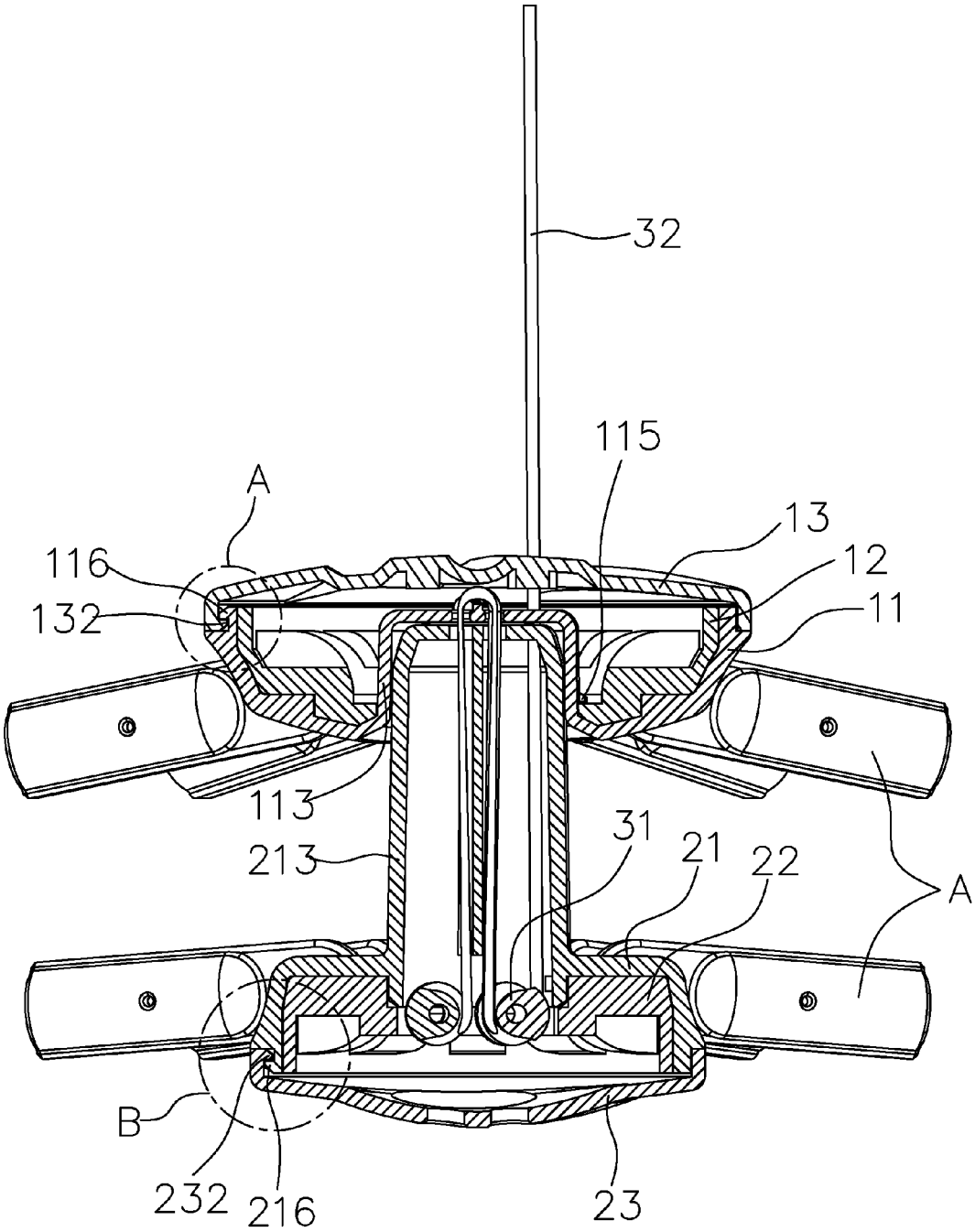
FIG. 5 is a sectional view taken along line D-D of FIG. 4.
Figure 5A:
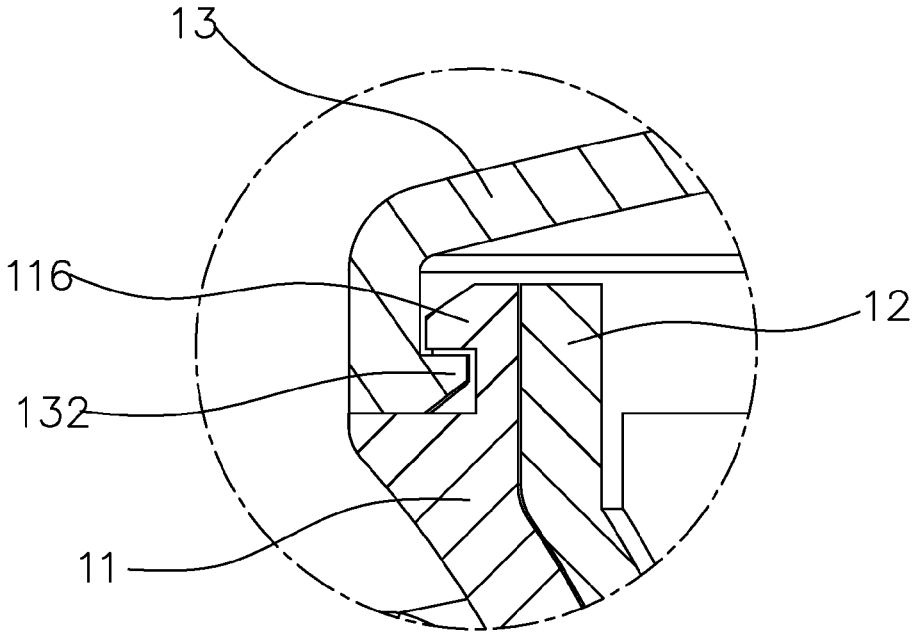
FIG. 5A is an enlarged view of circle A of FIG. 5.

The upper lid 13 is fitted on the upper seat 11. The upper lid 13 has an annular rim 131 and a plurality of protruding blocks 132 formed on an inner wall of the annular rim 131. When the upper lid 13 is coupled to the upper seat 11, the protruding blocks 132 are tightly engaged with the engaging flanges 116 of the upper seat 11, as shown in FIG. 5 and FIG. 5A. Furthermore, the upper lid 13 has a plurality of holes 133 at a central portion thereof. The upper seat 11, the upper press member 12 and the upper lid 13 are assembled to form the upper module 1 of the present invention.

The configuration of the lower module 2 is similar to that of the upper module 1. The lower module 2 comprises a lower seat 21, a lower press member 22 and a lower lid 23 which are separately formed and then connected with each other. The lower seat 21 has a plurality of engaging grooves 211 which are spaced and arranged in a radial form for connection of the connecting heads A of the tent poles. The lower seat 21 further has an annular recess 212 formed on an inner wall thereof to accommodate the pivots of the connecting heads A of the tent poles. The lower seat 21 further has a hollow axle portion 213 protruding from a central portion thereof. The axle portion 213 has an end formed with a plurality of apertures 214 and an annular trough 215 formed on an outer wall of a bottom end thereof. The lower seat 21 further has a plurality of engaging flanges 216 around an outer wall thereof and a plurality of engaging holes 217.

The lower press member 22 corresponds in shape to the inner wall of the lower seat 21 and is coupled to the lower seat 21. The lower press member 22 has a plurality of slots 221 corresponding to the engaging grooves 211 and stop blocks 222 disposed above the slots 221. The slots 221 are aligned with the engaging grooves 211 of the lower seat 21 and cooperated with the stop blocks 222, such that the connecting heads A of the tent poles can be secured in the engaging grooves 211 of the lower seat 21 of the lower module 2 and the connecting heads A of the tent poles can be turned in a predetermined range to unfold or fold the tent poles. The lower press member 22 has a central installing trough 223 corresponding to the axle portion 213. The installing trough 223 is used to accommodate a pulley unit 31 of a quick-release assembly 3. The installing trough 223 has protrusions 224 formed on a bottom edge thereof. The outer wall of the lower press member 22 has engaging blocks 225 corresponding to the engaging holes 217. When the lower press member 22 is pressed and connected in the lower seat 21, the engaging blocks 225 are engaged with engaging holes 217 of the lower seat 21. The lower press member 22 is firmly coupled to the lower seat 21 by means of the protrusions 224 formed on the bottom of the installing through 223 to engage with the annular trough 215 of the axle portion 213, referring to FIG. 6, FIG. 6B, FIG. 7 and FIG. 7B.

Figure 5B:
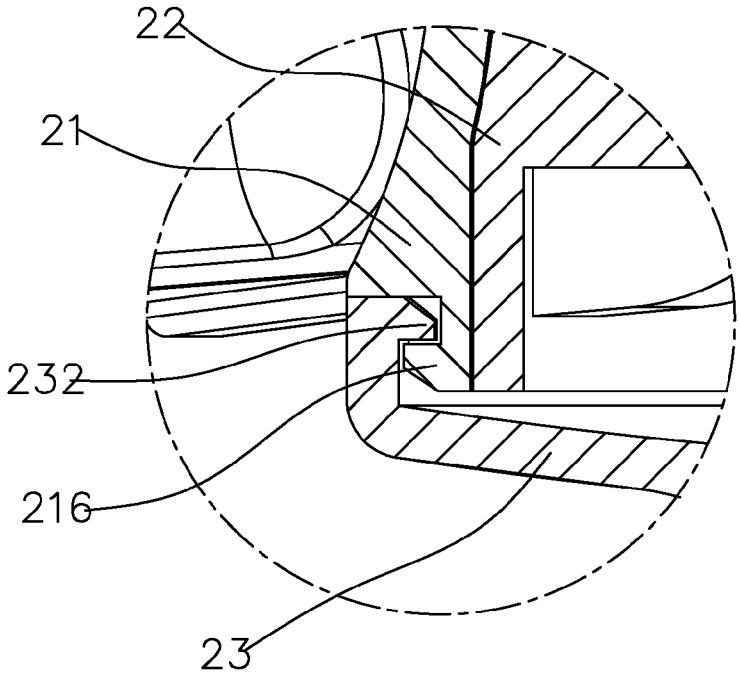
FIG. 5B is an enlarged view of circle B of FIG. 5.
Figure 6:
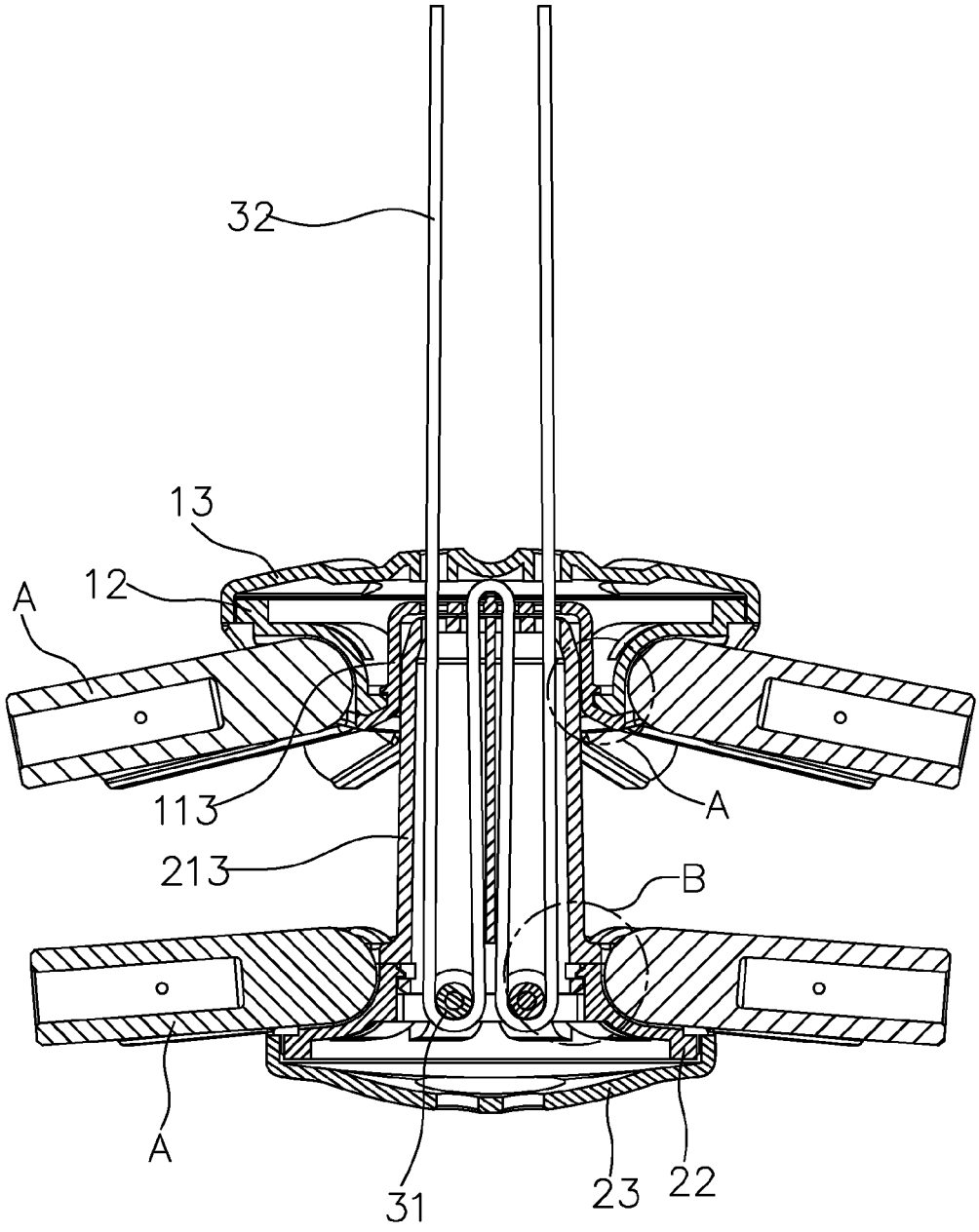
FIG. 6 is a sectional view taken along line B-B of FIG. 4.
Figure 6A:
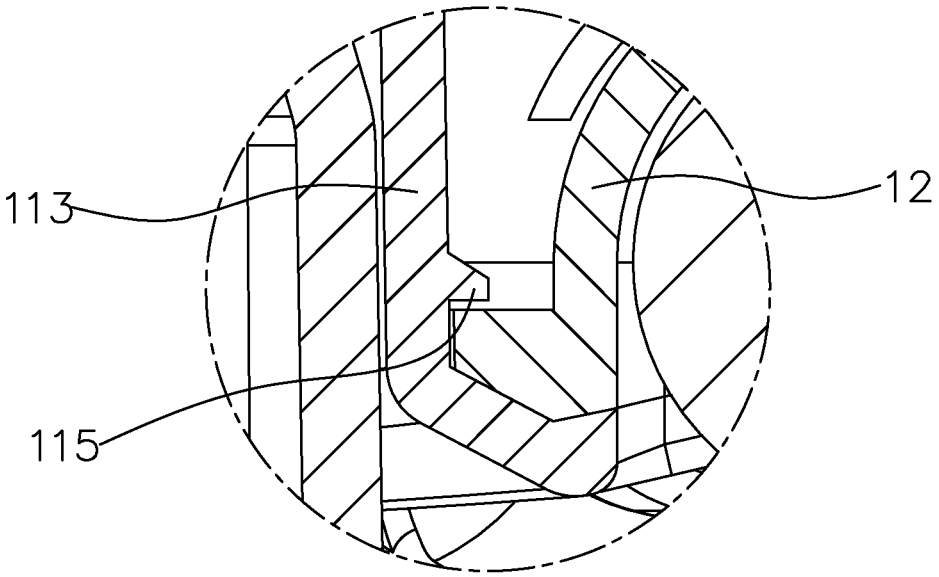
FIG. 6A is an enlarged view of circle A of FIG. 6.
Figure 6B:
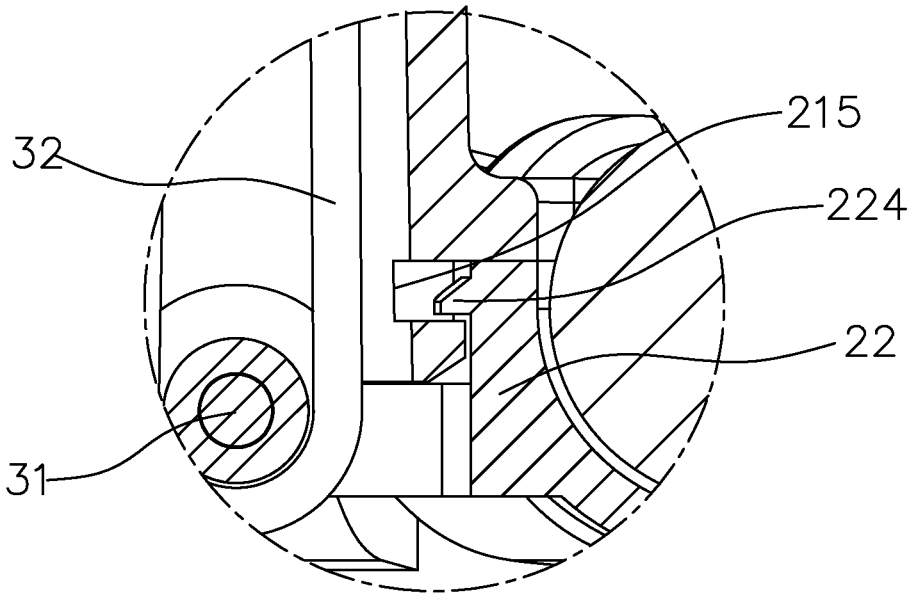
FIG. 6B is an enlarged view of circle B of FIG. 6.
Figure 7:
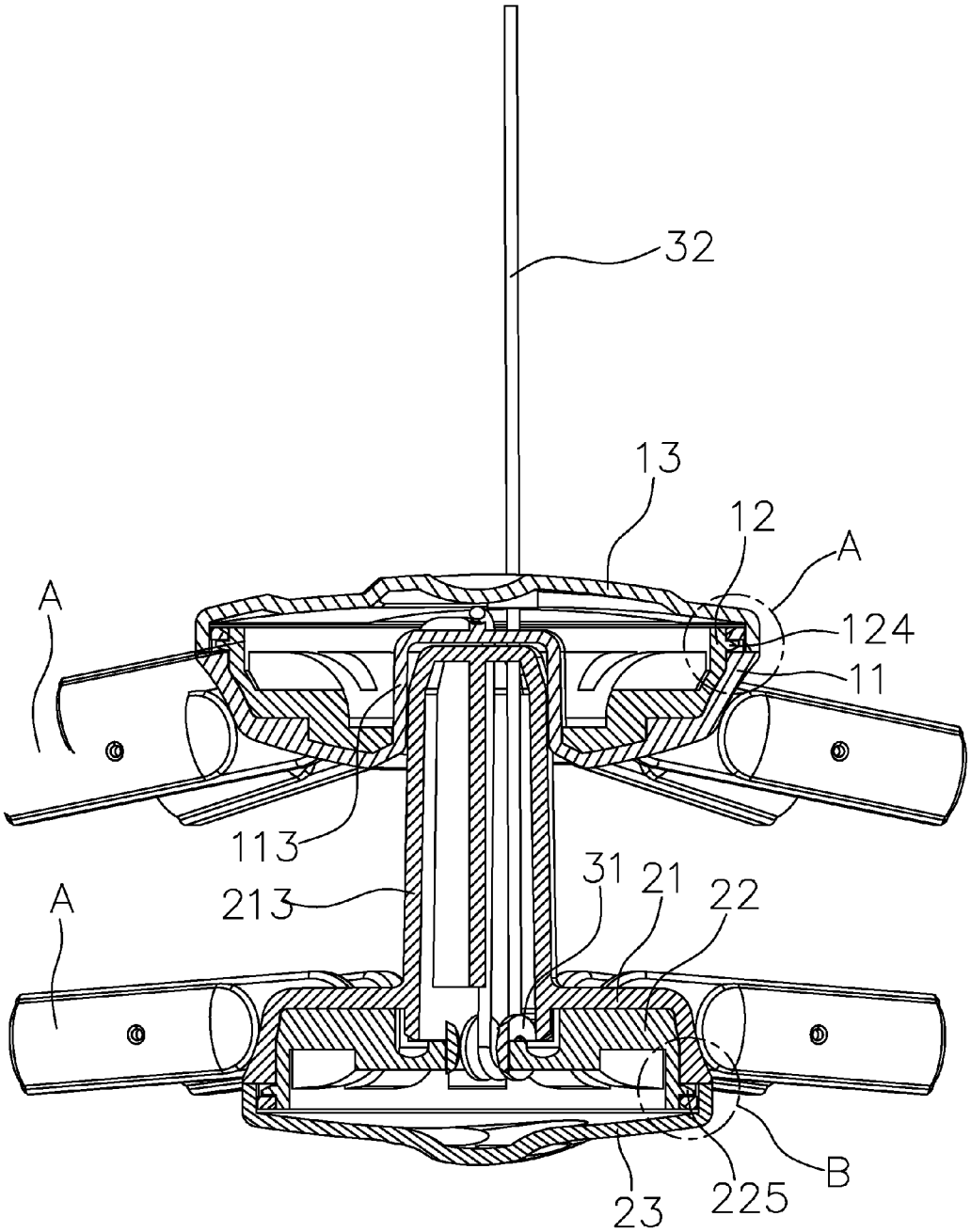
FIG. 7 is a sectional view taken along line C-C of FIG. 4.
Figure 7A:
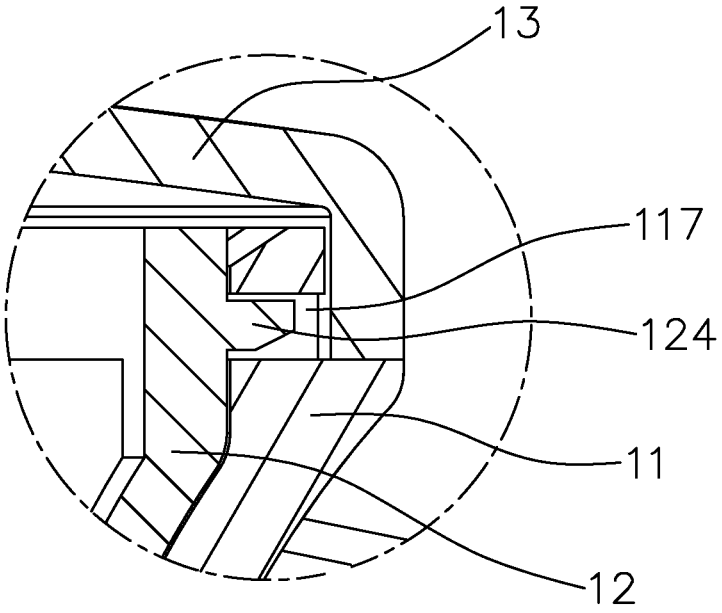
FIG. 7A is an enlarged view of circle A of FIG. 7.
Figure 7B:
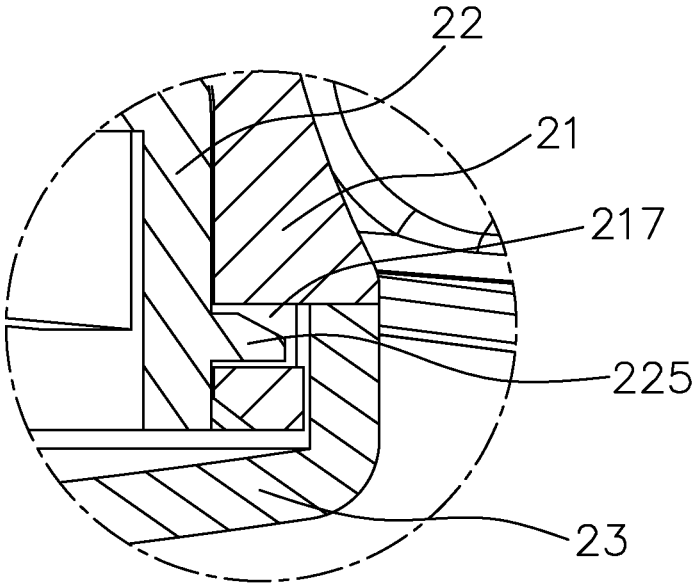
FIG. 7B is an enlarged view of circle B of FIG. 7.

The lower lid 23 is fitted on the lower seat 21. The lower lid 23 has an annular rim 231 and a plurality of protruding blocks 232 formed on an inner wall of the annular rim 231. When the lower lid 23 is coupled to the lower seat 21, the protruding blocks 232 are tightly engaged with the engaging flanges 216 of the lower seat 21, as shown in FIG. 5 and FIG. 5B. Furthermore, the lower lid 23 has a plurality of holes 233 at a central portion thereof. The lower seat 21, the lower press member 22 and the lower lid 23 are assembled to form the lower module 2 of the present invention.

To assemble, the connecting heads A of the tent poles are placed in the engaging grooves 111 of the upper seat 11, and then the upper press member 12 and the upper lid 13 are coupled to the upper seat 11. In the same way, the lower module 2 is assembled and the lower module 2 is provided with the quick-release assembly 3. The quick-release assembly 3 comprises a pulley unit 31 and a pull rope 32. The pull rope 32 winds round the pulley unit 31, passes the apertures 214 of the axle portion 213 of the lower seat 21 and the through holes 114 of the bearing base 113 of the upper seat 11, and extends out of the holes 133 of the upper lid 13. Finally, the bearing base 113 of the upper seat 11 of the upper module 1 is fitted on the axle portion 213 of the lower seat 21 of the lower module 2 so assemble the upper and lower modules 1, 2. The pull rope 32 is pulled to link the pulley unit 31 to bring the upper and lower modules so as to unfold or fold the tent.

The connecting structure of the upper seat 11, the upper press member 12 and the upper lid 13 of the upper module 1 and the connecting structure of the lower seat 21, the lower press member 22 and lower lid 23 of the lower module 2 are not limited to the aforesaid.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tent to assembly mounted on top of a tent for connecting with a plurality of tent poles, the tent to assembly comprising an upper module and a lower module and characterized by: the upper module comprising an upper seat, an upper press member and an upper lid which are separately formed and connected with each other; the lower module comprising a lower seat, a lower press member and a lower lid which are separately formed and connected with each other; the upper seat and the lower seat each having a plurality of engaging grooves which are spaced and arranged in a radial form for connection of connecting heads of the tent poles, wherein the upper seat further has an annular recess formed on an inner wall thereof, the upper seat further having a bearing base protruding from a central portion thereof, the bearing base having protrusions formed on an outer wall thereof, the upper seat further having a plurality of engaging flanges around an outer wall thereof and a plurality of engaging holes.

2. The tent top assembly as claimed in claim 1, wherein the upper press member corresponds in shape to the inner wall of the upper seat and is coupled to the upper seat, the upper press member having a plurality of slots corresponding to the engaging grooves of the upper seat and stop blocks disposed above the slots, the upper press member having a central mating hole corresponding to the bearing base and engaging blocks which are disposed on an outer wall of the upper press member and correspond to the engaging holes of the upper seat.

3. The tent top assembly as claimed in claim 1, wherein the upper lid is fitted on the upper seat, the upper lid having an annular rim and a plurality of protruding blocks formed on an inner wall of the annular rim and corresponding to the engaging flanges of the upper seat.

4. A tent top assembly mounted on top of a tent for connecting with a plurality of tent poles, the tent top assembly comprising an upper module and a lower module and characterized by: the upper module comprising an upper seat, an upper press member and an upper lid which are separately formed and connected with each other; the lower module comprising a lower seat, a lower press member and a lower lid which are separately formed and connected with each other; the upper seat and the lower seat each having a plurality of engaging grooves which are spaced and arranged in a radial form for connection of connecting heads of the tent poles, wherein the lower seat further has an annular recess formed on an inner wall thereof, the lower seat further having a hollow axle portion protruding from a central portion thereof, the axle portion having an annular trough formed on an outer wall of a bottom end thereof, the lower seat further having a plurality of engaging flanges around an outer wall thereof and a plurality of engaging holes.

5. The tent top assembly as claimed in claim 4, wherein the lower press member corresponds in shape to the inner wall of the lower seat and is coupled to the lower seat, the lower press member having a plurality of slots corresponding to the engaging grooves of the lower seat and stop blocks disposed above the slots, the lower press member having a central installing trough corresponding to the axle portion, the installing trough being used to accommodate a quick-release assembly, the installing trough having protrusions formed on a bottom edge thereof, the lower press member having an outer wall formed with engaging blocks corresponding to the engaging holes.

6. The tent top assembly as claimed in claim 5, wherein the quick-release assembly comprises a pulley unit and a pull rope, the pulley unit being disposed in the installing trough of the lower seat, the pull rope winding round the pulley unit, passing the apertures of the axle portion of the lower seat and the through holes of the bearing base of the upper seat and extending out of the holes of the upper lid.

7. The tent top assembly as claimed in claim 4, wherein the lower lid is fitted on the lower seat, the lower lid having an annular rim and a plurality of protruding blocks formed on an inner wall of the annular rim and corresponding to the engaging flanges of the lower seat.

* * * * *